US005613863A

United States Patent [19]

Klaus et al.

[11] Patent Number: 5,613,863

[45] Date of Patent: Mar. 25, 1997

[54] POWER TRANSFORMER

[75] Inventors: Thomas R. Klaus, Palatine; Stephen J. Milligan, Mundelein, both of Ill.

[73] Assignee: Motorola, Inc., Schaumburg, Ill.

[21] Appl. No.: 444,181

[22] Filed: May 18, 1995

[51] Int. Cl.[6] ..... H01R 13/44

[52] U.S. Cl. ..... 439/131; 439/172; 439/173; 439/218

[58] Field of Search ..... 439/131, 518, 439/170, 171, 172, 173, 174

[56] References Cited

U.S. PATENT DOCUMENTS

| | | | |
|---|---|---|---|
| D. 350,113 | 8/1994 | Nagele . | |
| 4,543,624 | 9/1985 | Rumble | 439/518 X |
| 4,973,827 | 11/1990 | Nozaki | 439/172 X |
| 4,997,381 | 3/1991 | Oh | 439/131 X |
| 5,159,545 | 10/1992 | Lee | 439/173 X |
| 5,423,690 | 6/1995 | Selker et al. | 439/173 X |

*Primary Examiner*—Jes F. Pascua
*Attorney, Agent, or Firm*—Randall S. Vaas

[57] ABSTRACT

A universal power transformer (101) is for connection to an AC power source and produces a regulated DC voltage at an output thereof. The power transformer includes a power transformer housing (102) with a recess (114). A universal power converter circuit (313) is positioned in the housing. Connector prongs (108, 110) are electrically coupled to the circuit and are movably carried on the housing at a position adjacent the recess. The prongs move between an outwardly extending position, projecting from the housing for connection to a first type of power supply connector, and a retracted position, extending into the recess for storage during transport of the power transformer and for connection to an adapter (103–106) positioned in the recess, to connect to a second type of power supply connector.

17 Claims, 7 Drawing Sheets

— PRIOR ART —

POWER TRANSFORMER

FIELD OF THE INVENTION

The present invention pertains to power transformers, and more particularly to power transformers of the type used with power supplies found in different regions of the world.

BACKGROUND OF THE INVENTION

Power transformers are used to convert an AC power supply of the type available in homes, offices, hotels and the like, via an ordinary wall outlet, to a DC power supply compatible with electronic devices, such as radio telephones, telephones, answering machines, calculators, computers, radios, and the like. These power transformers are used to reduce dependence upon batteries, or to provide charging energy for rechargeable batteries from available AC power sources. To provide the regulated power supply, the transformer includes a power converting circuit within a housing having a male connector positioned thereon. The male connector is for connection to a female connector of a main power supply wall outlet.

Because power transformers are often used with portable devices, they have been developed to facilitate transport with the portable devices. One known transformer includes pivoting prongs that move into the transformer housing for storage during travel and pivot to an outwardly projecting position for connection to a wall outlet. These connectors have improved compactness when folded, to minimize the storage space that they require, thereby facilitating packing by travelers or commuters.

A difficulty encountered by travelers is powering their electronic equipment from the main power supplies found in different regions of the world. This difficulty arises because power supplies in different countries have different voltages, currents, and supply frequency characteristics. They also have different wall outlet female connector configurations. Although power converter circuits have been developed which produce a regulated DC voltage (e.g., five volts) from most main power supply signals found throughout the world, accommodating the different female connectors has been more difficult.

Typically, transformers have a male connector with prongs for one type of wall outlet. Adapters are employed to connect these connector prongs to other types of wall outlet female connectors. Such adapters have a female connector for receipt of the male connector prongs on the power transformer housing and a male connector for connection to the wall outlet female connector. A difficulty with these adapters is that they space the transformer housing from the wall outlet by at least the length of the prongs of the male connector on the power transformer housing. Because of this spacing, a substantial torque is exerted through the adapter to the wall outlet if a force is exerted against the transformer housing.

Accordingly, it is desirable to provide an improved universal power transformer system.

DETAILED DESCRIPTION OF THE DRAWINGS

Figure 1:
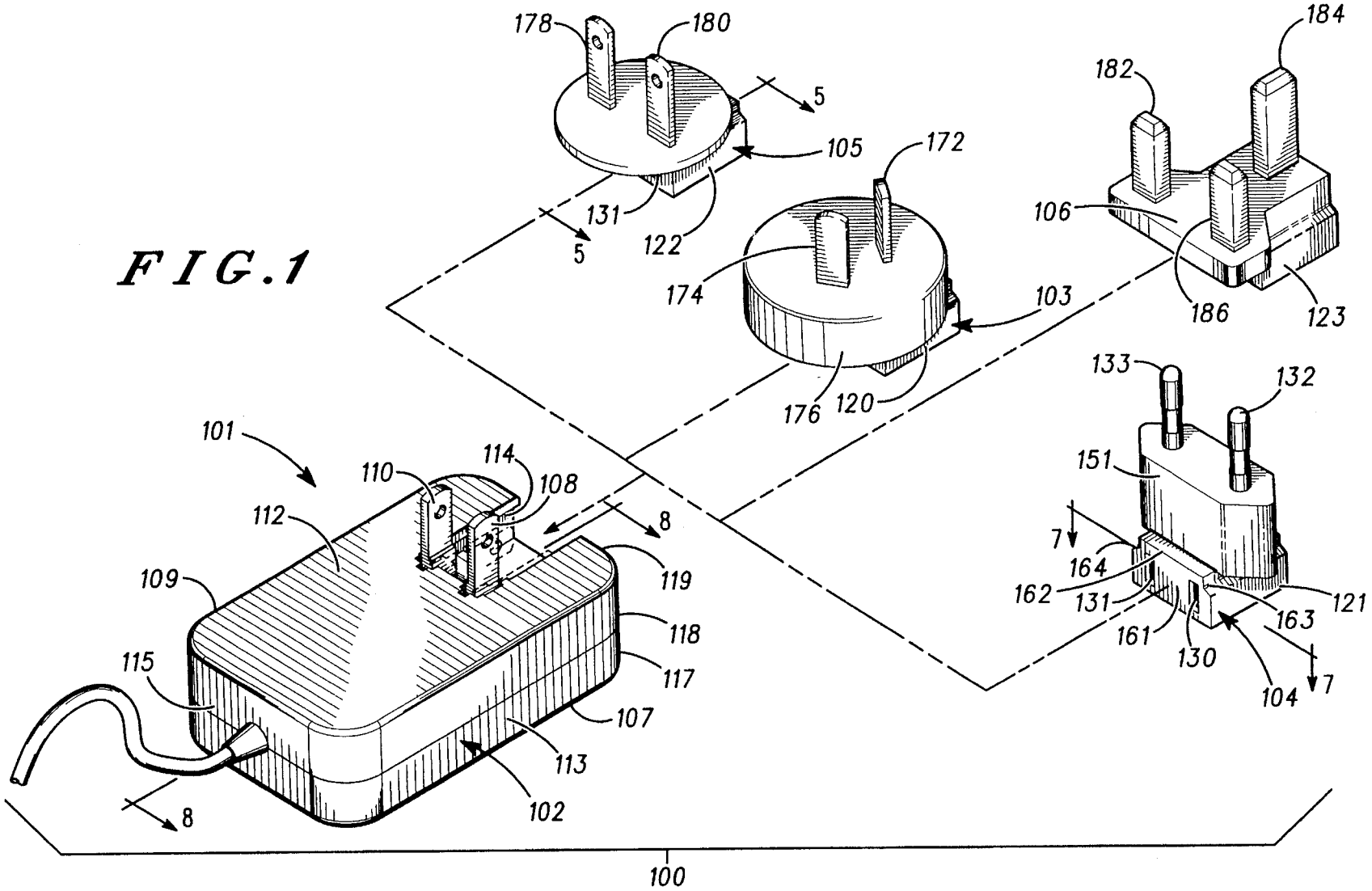
FIG. 1 is a front, right side and bottom perspective view illustrating a power transformer system which includes a power transformer housing and adapters therefor.

A universal power transformer is for connection to a main power supply and produces a regulated output voltage at an output thereof. The power transformer includes a universal power converter circuit positioned in a housing. The housing includes a recess. A prong is electrically coupled to the circuit and is movably carried on the housing at a position adjacent the recess. The prongs move between an outwardly extending position, projecting from the housing for connection to a first type of power supply wall outlet, and a retracted position, extending into the recess for storage during transport of the power transformer and for connection to an adapter received in the recess. The adapter is employed to connect the power transformer to a second type of power supply outlet.

A power transformer system 100 (FIG. 1) includes a power transformer 101, and a plurality of adapters 103–106. The power transformer 101 includes a power transformer housing 102 having a front wall 112 with a recess, or channel, 114 therein. Connector prongs 108 and 110, which together provide a male connector, are mounted on the power transformer housing 102 proximate recess 114. The connector prongs are movingly positioned in association with recess 114. When in an outwardly projecting position, extending orthogonally from wall 112 as shown in solid in FIG. 1, the prongs are positioned to be inserted into a first type of power outlet (a 110 volt alternating current (AC) wall outlet of the type used in the United States of America). In a retracted, or collapsed, position, illustrated in solid in FIG. 2, connector prongs 108 and 110 extend into recess 114. In this position they are stored for transport or for connection to one of adapters 103–106 received in the recess, as described in greater detail hereinbelow.

Figure 2:
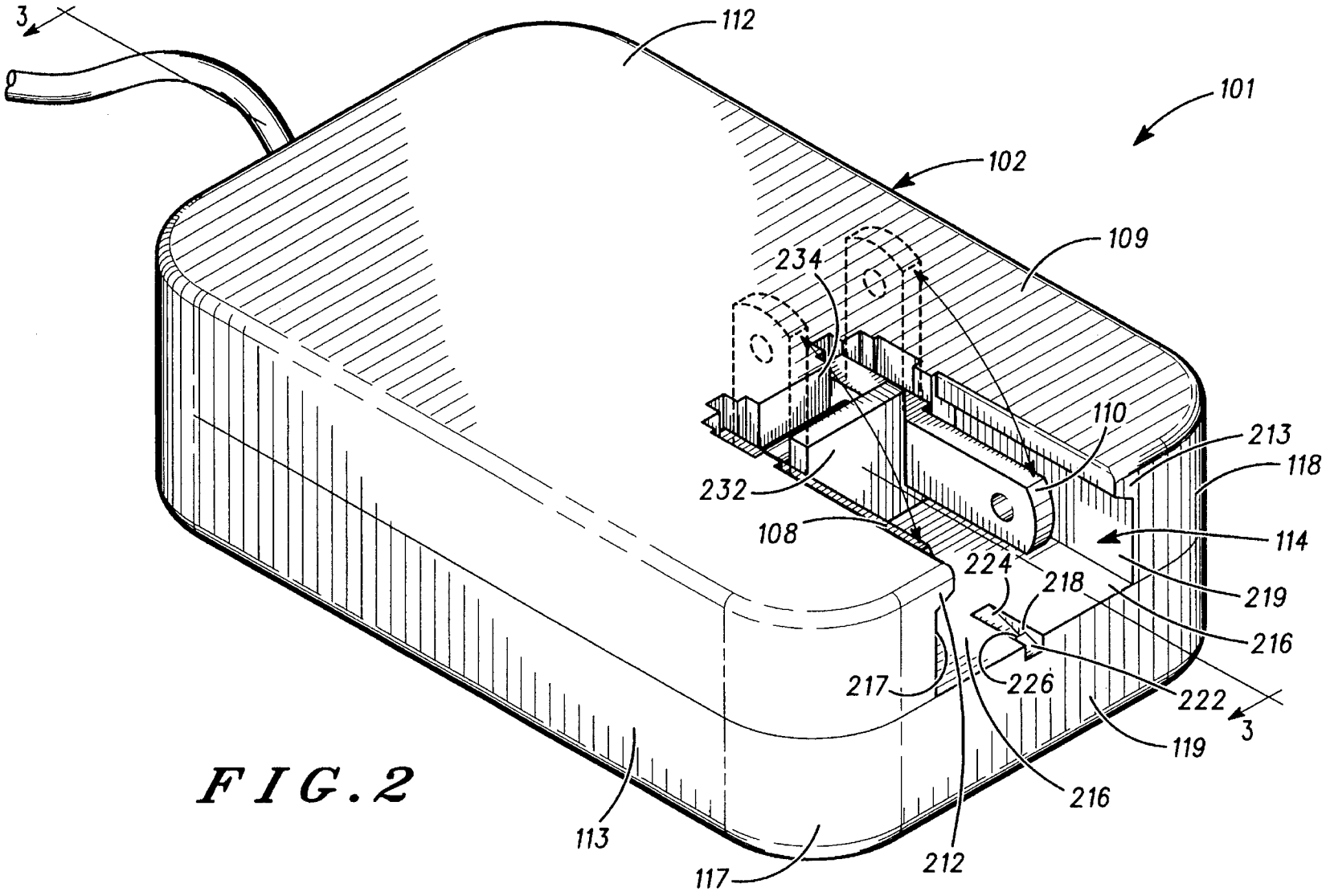
FIG. 2 is an enlarged front, right side, and top perspective view illustrating the power transformer according to FIG. 1.

The power transformer housing 102 (FIG. 1) is generally rectangular, including a front wall 112, a right side wall 113, a bottom wall 115, and a top wall 119 ( best shown in FIG. 2). A planar back wall 107, opposite front wall 112, and a left side wall 109, identical to right side wall 113, are not shown. The power transformer housing 102 is manufactured of any suitable material, such as a dielectric material, and may for example be a molded polymer. The housing is preferably constructed in two shells 117, 118 that define a hollow interior when interconnected. The shells are interconnected using an adhesive, snap connectors (not shown), threaded fasteners (not shown), or the like. The shells 117 and 118 define a cylindrical hollow 315 for receipt of an axle 316 which rotates therein.

The recess 114 is formed in the front wall 112 and the top wall 119, as best shown in FIG. 2. The recess is preferably configured as a channel, having a wide lower volume defined by a recess front wall 216 extending in a plane substantially parallel to transformer front wall 112, side walls 217 and 219 extending orthogonally from recess front wall 216 and terminating at projections 212 and 213. Projections 212 and 213 extend inwardly toward one another along front wall 112. The recess front wall 216 includes a complementary latch mechanism 218. The latch mechanism includes an outer slide surface 222, an inner slide surface 224, and a catch 226 that extends between the outer slide and the inner slide surfaces. The channel 114 terminates at a recess stop wall 232. Axle 316 is supported in the cylindrical hollow between stop wall 232 and an end wall 234.

Figure 4:
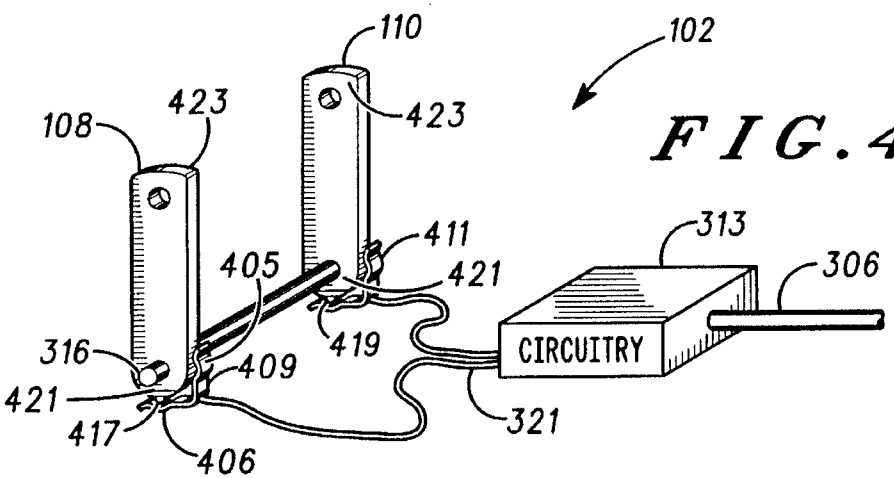
FIG. 4 is a perspective view illustrating prongs, an axle, contacts, conductors and circuitry for the power transformer according to FIG. 1.

The power transformer housing 102 (FIG. 4) houses connector prongs 108 and 110, a contact 409, a contact 411, and universal power converter circuit 313. Connector prongs 108 and 110 include protrusions, or dimples,. 417 and 419 on the proximal, or axial, end 421. The distal end 423 of the prongs is for electrical connection with contacts of one type of wall outlet female connector. The connector prongs 108 and 110 are illustrated supported on an axle 316. The prongs are preferably fixedly secured to the axle such that the prongs and axle rotate together. The axle is manufactured of a suitable dielectric material, such as a molded polymer. The connector prongs 108 and 110 are manufactured of a suitable electrically conductive material, such as a beryllium-copper stamping.

Figure 3:
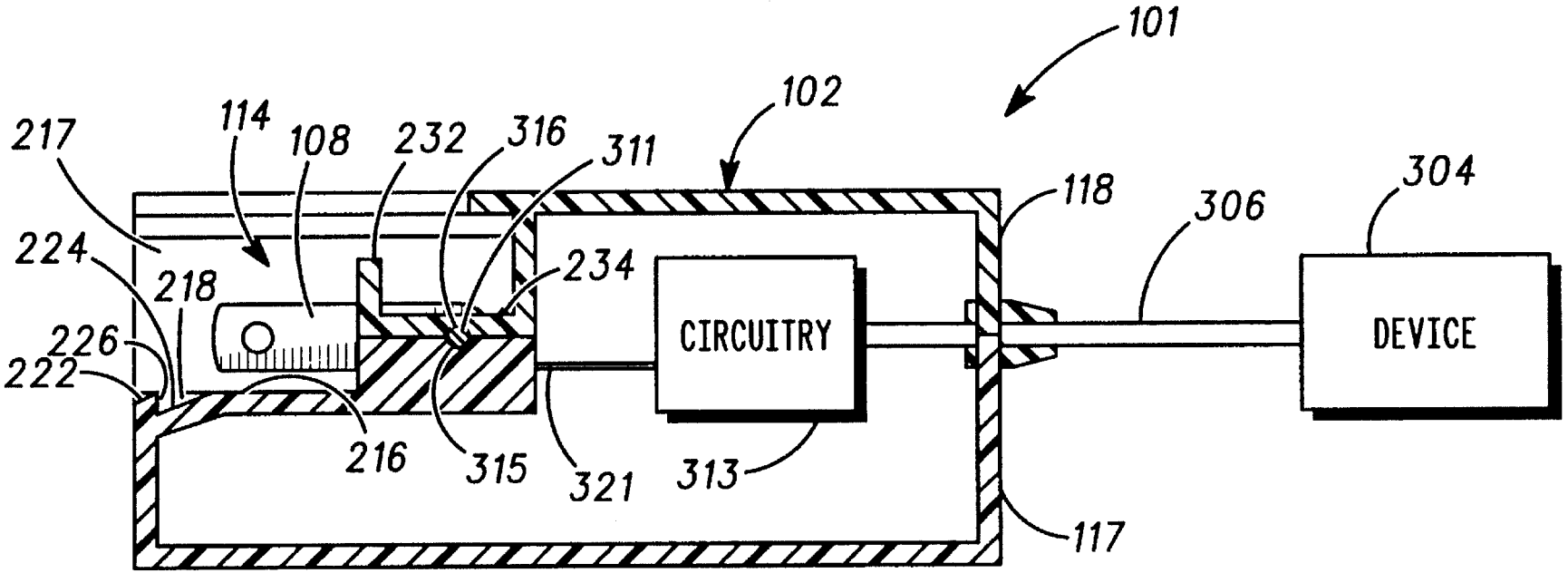
FIG. 3 is a cross-sectional view illustrating the power transformer taken along plane 3—3 in FIG. 2.

Contacts 409 (FIG. 4) and 411 are positioned in power transformer housing 102 to contact protrusions 417 and 419 on connector prongs 108 and 110. Each of contacts 409 and 411 has a generally L shaped profile, including two orthogonal arms 501 (FIG. 4) and 503. The contacts are identical, accordingly only contact 409 is described in greater detail herein. Each arm 501 and 503 includes a respective detent 405 and 406 for indexed positioning of connector prong 108 (FIG. 3) when protrusion 417 is positioned in the detent. By engaging the detent, the protrusion 417 releasable holds the connector prongs 108 and 110 in a predetermined orientation. This holding force helps the prong resist pivoting while the connector prong 108 is inserted into a female connector. Additionally, in the retracted position, the prong is held against pivoting out of the recess during travel. The contacts 409 and 411 are electrically connected to the connector prongs 108 and 110, respectively, in both the outwardly projecting position of FIG. I and the retracted position of FIG. 2.

The contacts 409 (FIG. 4) and 411 are connected via two wire cable 321 to a universal power converter circuit 313. The power converter circuit may be implemented using any suitable conventional power transformer that produces a regulated output voltage (e.g., five volts DC) from a supply voltage input thereto. The supply voltage will typically be an AC voltage in the range between approximately 100 and 240 Volts AC. The universal power converter circuit 313 is thus of the type operable with many conventional main power supplies, including those available in most countries. The output of the universal power converter circuit 313, having the regulated voltage level thereon, is connected to a device 304 (FIG. 3) via cable 306. The device 304 may be a telephone, such as a cellular telephone, a cordless telephone, a radio, a calculator, a tape player, a portable computer, an answering machine, or the like.

Figure 5:
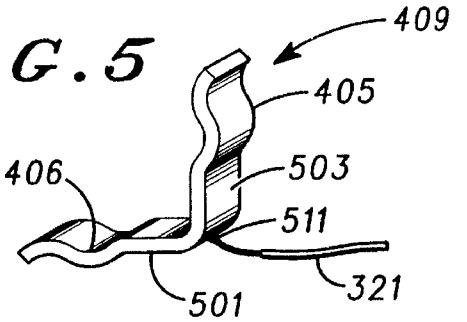
FIG. 5 is a perspective view illustrating a contact for the power transformer according to FIG. 2.

The contacts 409 and 411 are connected to cable 321 by any suitable means, such as weldmont 511 (FIG. 5), a connector (not shown), or the like.

Adapter 104 (FIG. 1) is described herein. Adapter 104 includes base 121 and an upper body 151. The upper body 151 and base 121 are manufactured of a suitable material, such as integrally molded of a dielectric material. The adapter may be molded in two shells (not specifically shown) which are connected by suitable means (not shown) such as snap connectors, threaded fasteners, adhesive, or the like. The shells form two channels for receipt of the prongs 132 and 133, which extend through the body 151 into the base 121. The prongs 132 and 133 are manufactured of a suitable conductive material, such as a metal alloy, and are electrically isolated from one another by the upper body.

The base 121 is configured as a rail, which is keyed for receipt in recess 114. The rails include a wide bottom for mating engagement with the lower portion 210 of recess 114. The base includes a wide bottom wall 161. The top 162 of the base is narrow to slide between the projections 212. Surfaces 163 and 164 are sloped to abut with projections 212 and 213.

Figure 6:
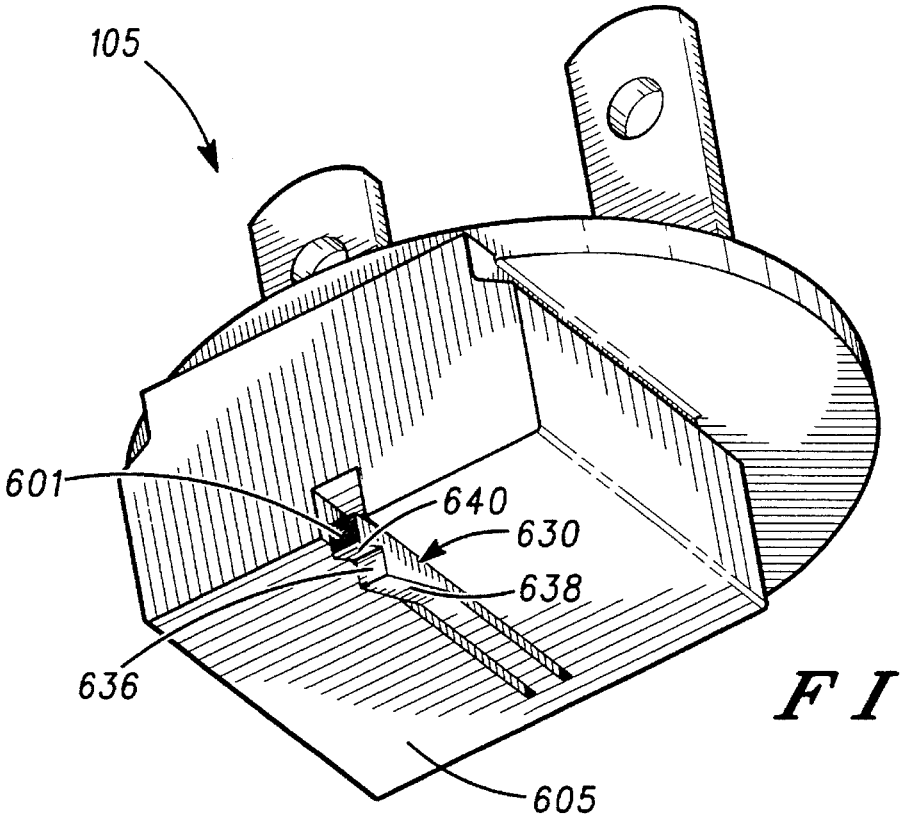
FIG. 6 is a side cross-sectional view illustrating the power transformer taken along plane 6—6 in FIG. 1 and a side elevational view of an adapter and a device therewith.

The base 121 includes an adapter latch 630 (FIG. 6) which is a resilient member projecting from adapter bottom wall 605. The latch includes a catch wall 636, a slide surface 638, and a recessed surface 640, on a lower surface thereof. As best illustrated in FIG. 6, a distal end 601 of the adapter latch 630 includes ribs which facilitate griping thereof. The latch 630 is sufficiently long that end 601 extends beyond top wall 119 when end wall 161 abuts with stop wall 232.

The base 121 forms a hollow shell that houses internal contacts 701 (FIG. 7) and 703 positioned behind openings 130 and 131. These internal female contacts are mounted on the top surface of bottom wall 605 by suitable means (not shown). These contacts each include resilient arms 705 and 707 to receive and electrically couple with connector prongs 108 and 110, respectively. The contacts each further includes resilient arms 709 and 711 which receive and electrically couple to prongs 132 and 133. The contacts 701 and 703 are manufactured of any suitable electrically conductive material, such as a metal alloy. The electrical contacts are to electrically connect connector prongs 108 and 110 to prongs 132 and 133 when the adapter is inserted into recess 114 while connector prongs 108 and 110 are positioned in the recess, as described in greater detail hereinbelow. Thus, by connecting prongs 132 and 133 to a power source (wall outlet), power is supplied through the adapter 103 to connector prongs 108 and 110.

It will be recognized by those skilled in the art that the adapters 103–106 are similar in construction. Accordingly, adapters 103, 105, 106 will be described only briefly. The adapters 103, 105 and 106 (FIG. 1) include respective bases 120, 122, and 123 for mating engagement with recess 114. Each base is identical to base 121, such that it includes openings (not shown) identical to openings 130 and 131 and internal contacts identical to 701 and 703. The adapter 103 also includes adapter prongs 172 and 174 on cylinder body 176 for insertion into a second type of power supply connector. Adapter 105 includes adapter prongs 178 and 180 for connection to a third type of power supply connector. Adapter 106 includes adapter prongs 182, 184, and 186 for connection to a fourth type of power supply connector. For each of these adapters, internal connectors include contacts for connecting the outwardly projecting connector prongs 108, 110 when the respective bases 120–124 are inserted into the recess 114.

Those skilled in the art will recognize that each of the adapters 103 (FIG. 1) to 106 includes respective internal contacts 701 (FIG. 7) and 703 positioned adjacent openings 130 and 131 connected to its respective prongs. Adapters 103, 104, 105 and 106 are adapted to be plugged into respective, different, types of conventional wall outlets (not shown).

Figure 11:
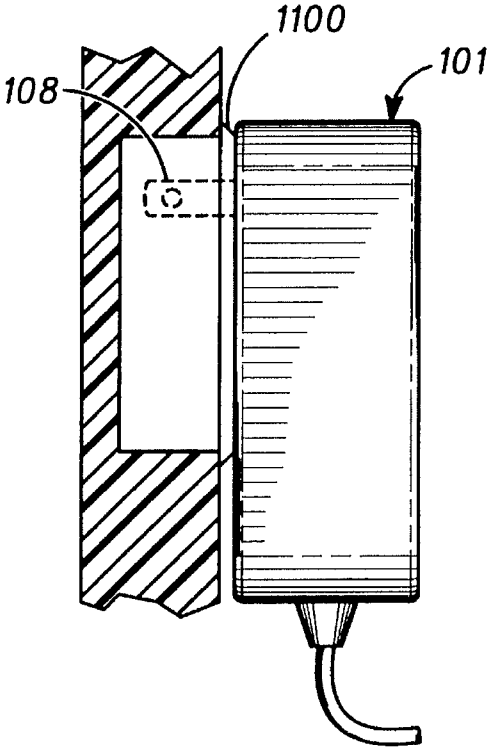
FIG. 11 is a side view illustrating a power transformer according to FIG. 2 connected directly to a wall outlet.

In operation, the user positions the connector prongs 108 and 110 in the outwardly projecting position of FIG. 1 to connect the power transformer housing 102 directly to a wall outlet 1100 (FIG. 11) which is compatible therewith. If the user need to move the prongs from recess 114, the user insert their finger into the recess 114 between the connector prongs 108 and 110 to pull their finger out. The recess is sufficiently large to permit the user to provide a relatively high level of access to the prongs, and the force required to remove the prong protrusion form the index position created by protrusions 417, 419, and detents 405, 406, are sufficiently low, that the user does not need to have a firm grip on the prongs to move them. After use, the prongs can be folded back into the recess for storage or transport. Because the prongs are folded down, the transformer housing is relative rectangular in configuration, and the prongs are folded in such that they will not snag to help prevent damage to articles of clothing, the inside of a brief case, or other articles.

Figure 8:
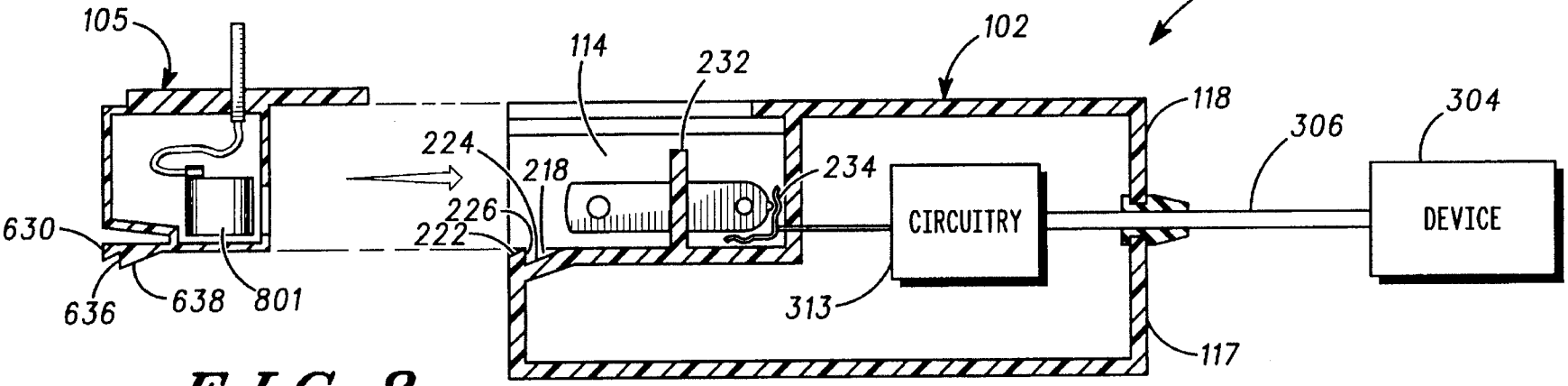
FIG. 8 is an enlarged top cross-sectional view illustrating an adapter taken along plane 8—8 in FIG. 1.
Figure 7:
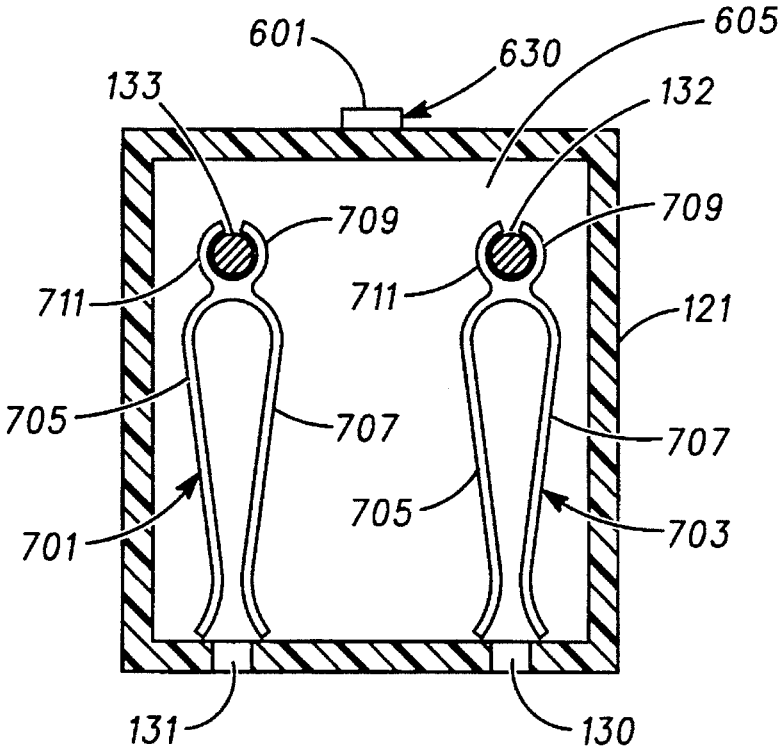
FIG. 7 is a rear, right side, and top perspective view illustrating one of the adapters according to FIG. 1.

If the wall outlet (not shown) to which the power transformer 101 (FIG. 1) is to be connected will not accommodate the connector prongs 108 and 110, the user selects an appropriate adapter 103–106 for this wall outlet. Although the insertion of the adapter will be described with respect to adapter 105, insertion of the other adapters is identical. When inserted into recess 114 (FIG. 8), the connector prongs 108 and 110 slide into, and make wiping electrical contact with, internal contacts 701 and 703 (FIG. 7). Slide surface 538 (FIG. 2) of adapter latch 630 moves over outer slide surface 222 of complementary latch mechanism 218. When catch wall 636 is past catch 226, the tang moves into latched engagement shown in FIG. 7. In this position, the adapter is held firmly in position between the abutment of catch wall 636 and catch 226, and the abutment of wide bottom wall 161 with stop wall 232. The stop walls prevent longitudinal axis sliding removal of the adapter.

Figure 9:
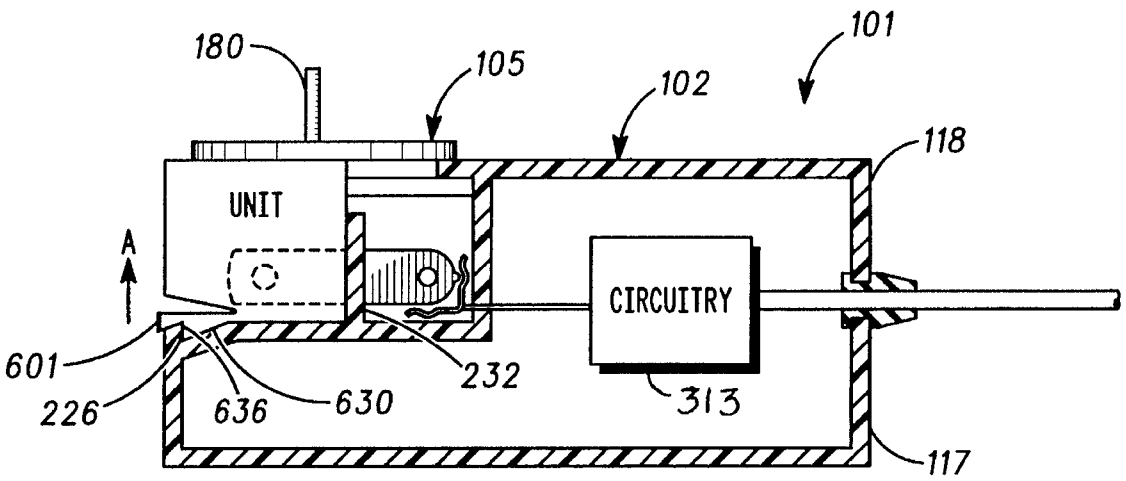
FIG. 9 is a side cross-sectional view illustrating the power transformer taken along the same plane as in FIG. 6 and illustrating the adapter fully inserted in the power transformer.
Figure 10:
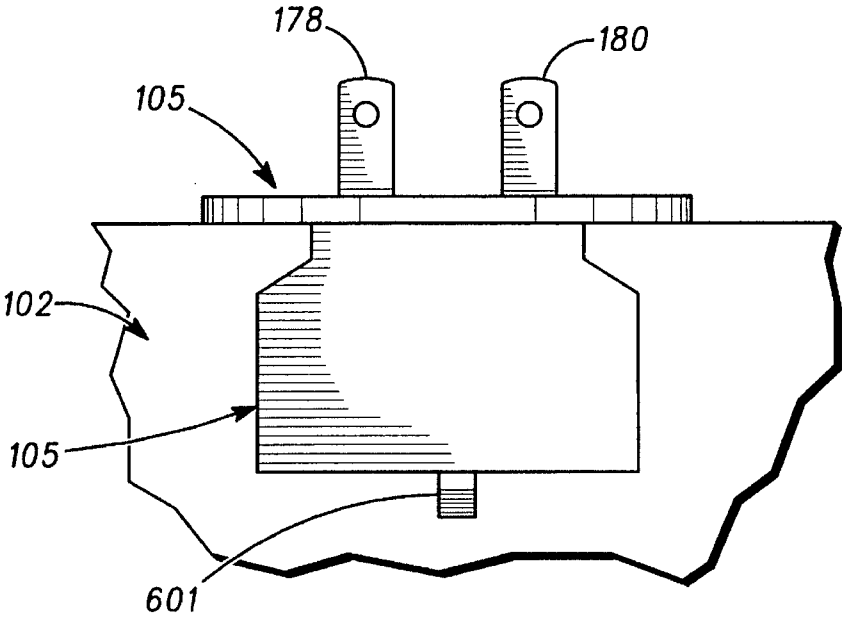
FIG. 10 is a fragmentary end view illustrating an adapter connected to a power transformer.

The end 601 extends beyond the top wall 119 sufficiently to allow the user to press the tang in direction A (FIG. 9) when the adapter 105 is fully inserted. To remove the adapter, the user presses adapter latch 630 in direction A, which moves catch wall 636 above catch 226. This allows the adapter to be slid longitudinally out of the recess 114.

The bases 120–123 of adapters 103–106 fit snugly within the recess 114. This snug fit provides friction between the adapter and the power transformer housing 102, which helps hold the adapter in and prevents movement of the adapter in the recess. Internal contacts 701 and 703 engaging connector prongs 108 and 110 provide additional frictional force against sliding removal of the adapter. The catch 226 and the complementary latching mechanism 218 lock adapters 103–106 in recess 114. When fully inserted, the adapter bases 120–123 are held against stop wall 232, which positions the adapter at a predetermined location. The adapter is thus firmly held in the recess 114.

Figure 12:
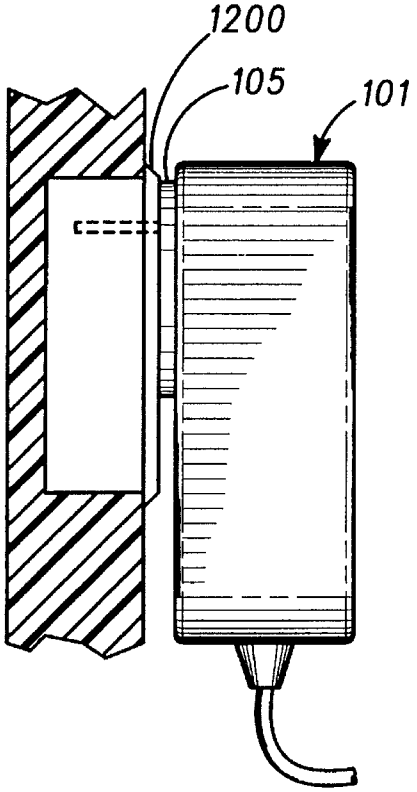
FIG. 12 is a side view illustrating a power transformer and an adapter connected directly to a wall outlet.

With the adapter 105 inserted into the power transformer housing 102, the transformer housing and adapter are plugged into the wall outlet 1200 (FIG. 12), compatible with this adapter. Because the adapter is inserted into the transformer housing, the adapter is positioned away from the wall, but is rather substantially flush to the wall. Surface 116 of front wall 112 is positioned against the wall outlet to provide stability against twisting when the connector prongs 108 and 110 are plugged into the wall outlet.

Figure 13:
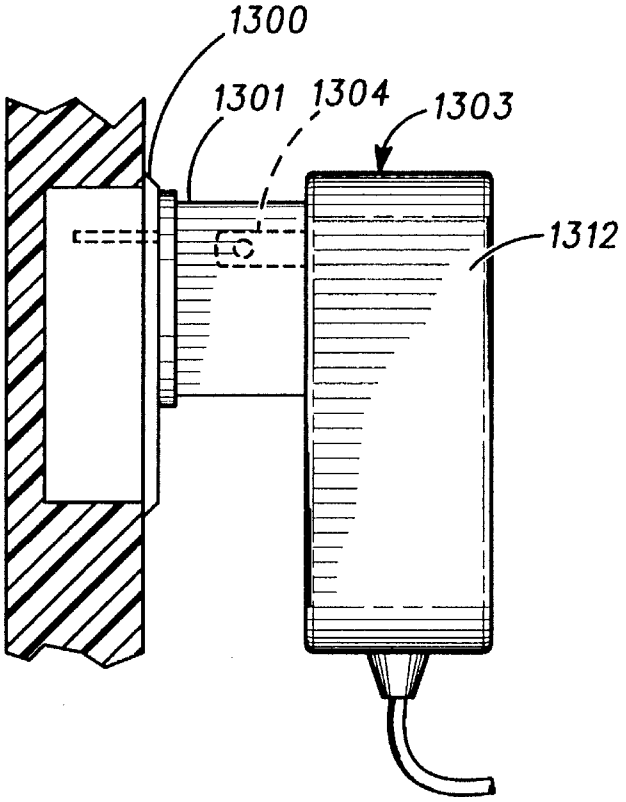
FIG. 13 is a side elevation view illustrating a prior art power transformer and adapter connected to a wall outlet.

Prior art adapters 1301 used with prior art power transformers 1303, such as that shown in FIG. 13, extend a significant distance from the wall. This spacing results from the adapter 1301 having to accommodate the full length of the prongs 1304 between the transformer housing 1312 and the wall outlet 1300. The immediate invention provides a more stable wall connection, which produces less torque in the internal contacts of the wall outlet if the transformer housing is bumped while it is connected to the wall outlet.

Thus it can be seen that a power transform is disclosed which is readily transportable in a compact, easy to pack, configuration that protect the prongs of the male connector. The transformer includes one pair of contacts which may be folded out for connection to a compatible wall outlets without having to carry adapters therefor. The transformer receives adapters into a recess therein such that the distance between the transformer housing and the wall is minimal. This helps hold the power transformer in the wall and protects the wall outlet.

The illustrated adapters 103 include a base received in the recess 114, such that the adapters are at least partially received in the recess. The adapters may be the same size as, or smaller than, the recess such that the entire adapter is received in the recess. This allows the power transformer and adapter to be spaced from the wall by a distance no greater than the power transformer without the adapter attached.

We claim:

1. In combination, a universal power transformer and an adapter, the adapter comprising a housing and connectors for connection to a second type of power supply; and the universal power transformer comprising a transformer housing including a recess for receipt of at least a portion of the adapter, a power converter circuit positioned in the housing, at least one prong movably carried on the housing at a position proximate to the recess to move between an outwardly extending position, projecting from the housing for connection to a first type of power supply connector, and a retracted position, extending into the recess for storage during transport of the power transformer and to connect to the adapter partially received in the recess, the at least one prong connected to a pivoting mechanism, such that the at least one prong pivots between the outwardly extending position and the retracted position, and at least one contact positioned in the transformer housing adjacent a proximal end of the at least one prong to contact the at least one prong in both the retracted position and the outwardly extending position, the at least one contact electrically coupling the at least one prong to the power converter circuit in both the outwardly extending position and the retracted position of the at least one prong.

2. The combination as defined in claim 1 wherein the recess is a groove.

3. The combination as defined in claim 1, further including an indexing mechanism for confirming and holding the position of the at least one prong at the retracted position and at the outwardly extending position.

4. The combination as defined in claim 3, wherein the indexing mechanism comprises a detent in the at least one contact.

5. The combination as defined in claim 1, wherein the recess includes a complementary latch mechanism.

6. The universal power transformer as defined in claim 5, further including the adapter.

7. The combination as defined in claim 1, wherein the adapter includes a latch.

8. The combination as defined in claim 7, wherein the adapter includes a housing and the latch is intergral to the housing.

9. The combination as defined in claim 8, wherein the adapter includes prongs for connection to the second type of connector and contacts for connection to the prongs positioned in the recess.

10. In combination, a universal power transformer and an adapter, the power transformer, including a housing including a recess, power converter circuit positioned in the housing, connector prongs movably carried on the housing at a position adjacent the recess to move between an extended position projecting outwardly from the housing for connection to a first type of power supply connector and a collapsed position extending into the recess, the connector prongs connected to a pivoting mechanism, such that the connector prongs pivot between the extended position and the collapsed position, and contacts positioned to contact the prongs in both the collapsed position and the extended position, the contacts coupled to the power converter circuit whereby the prongs are coupled to the power converter circuit; and at least one adapter including an adapter housing adapted to be positioned in the recess, adapter prongs carried on the adapter housing, the adapter prongs adapted to mate with a second type of power supply connector, and the adapter prongs electrically coupling to the connector prongs in the collapsed position when the adapter housing is inserted into the recess.

11. The combination as defined in claim 10, wherein the recess is a groove and the adapter housing includes a base complementary to the groove.

12. The combination as defined in claim 10, further including an indexing mechanism for confirming and holding the postition of the connector prongs at the extended position and the collapsed position.

13. The combination as defined claim 12, wherein the indexing mechanism is a detent integrally formed in the contacts.

14. The combination as defined in claim 10, wherein the recess includes a complementary latch mechanism.

15. The combination as defined in claim 14, wherein the adapter includes a latch mating with the complementary latch mechanism.

16. The combination as defined in claim 15, wherein the adapter includes a housing and the latch is integral to the adapter housing.

17. The combination as defined in claim 10 further including a plurality of adapters, each of which is mateable with a different type of wall outlet, and each of which is adapted to be connected to the power transformer upon positioning in the recess.

* * * * *